US005282755A

United States Patent [19]

Ahlstone

[11] Patent Number: 5,282,755

[45] Date of Patent: Feb. 1, 1994

[54] LOCKING DEVICE FOR FLUORESCENT LAMPS

[75] Inventor: Arthur G. Ahlstone, Ventura, Calif.

[73] Assignee: Vemco Corporation, San Dimas, Calif.

[21] Appl. No.: 5,669

[22] Filed: Jan. 19, 1993

[51] Int. Cl.[5] ..... H01R 33/02

[52] U.S. Cl. ..... 439/233; 439/232

[58] Field of Search ..... 439/232, 233, 234, 239, 439/242, 366

[56] References Cited

U.S. PATENT DOCUMENTS

| | | | |
|---|---|---|---|
| 2,401,408 | 6/1946 | Bixby | 439/232 |
| 3,466,594 | 9/1969 | Detch | 439/233 |
| 3,723,945 | 3/1973 | Detch | 439/233 |
| 3,892,457 | 7/1975 | Detch et al. | 439/233 |

*Primary Examiner*—Larry I. Schwartz
*Assistant Examiner*—Hien D. Vu

[57] ABSTRACT

A lamp lock for assembly of a fluorescent lamp with a lamp fixture is provided. A wafer-like body portion is made of electrically insulating material capable of use in the temperature range experienced by bi-pins of the fluorescent lamp. In use, the body portion is inserted between an axial end of the lamp and an adjacent face of the lamp fixture. The body portion has a leading edge and is provided with a slot extending through the leading edge for reception of the bi-pins. The lock further has a first lateral edge for sliding proximal engagement with a planar surface proximate to the lamp fixture for preventing the lock and the lamp from rotating, thereby securing the lamp to the lamp fixture. Preferably, the slot extends between, and in parallel alignment with, the first lateral edge and a second lateral edge of the body portion, such that the distance between the first lateral edge and the slot is greater than the distance between the second lateral edge and the slot. In this way, the lock may be used with at least two types or sizes of lamp fixtures, each of which having different spacing between the lamp holder surface and the bi-pins.

5 Claims, 1 Drawing Sheet

LOCKING DEVICE FOR FLUORESCENT LAMPS

FIELD OF THE INVENTION

This invention relates generally to locking devices, and, more particularly, is directed towards a locking device for preventing the rotation and removal of a fluorescent lamp from a fluorescent lamp holder.

BACKGROUND OF THE INVENTION

Fluorescent lamps are removed from conventional lamp holders on fluorescent lighting fixtures by rotating the lamp such that bi-pins of the lamp become aligned with a slot in the lamp holder, thereby allowing the bi-pins to pass through the slot and freeing the lamp. While installation and removal of fluorescent lamps is therefore relatively simple, conventional fluorescent lamp holders give rise to the possibility of the lamp being inadvertently rotated and disengaged from the lamp holder, such as during shipping or during an earthquake, for example. Such inadvertent disengagement of the lamp from the lamp holder can cause injury to persons below such lamps, especially in the case where such lamp fixtures are installed on a ceiling or high upon a wall. As such, an inexpensive and simple means by which to "lock" fluorescent lamps in their lamp holders is needed.

A locking means for fluorescent lamps is disclosed in U.S. Pat. No. 3,723,945 to Detch on Mar. 27, 1973. Such a device consists of a wafer-like member that is inserted between the end of a lamp and the lamp holder. Such a device has no less than two slots for engaging the bi-pins of the lamp, as well as a lug or two guide ribs or both. In use, the slots of the device engage the bi-pins of the lamp and the lug and/or guide ribs of the device engage the lamp holder. This combination prevents the lamp from rotating with respect to the holder. However, several considerable drawbacks exist with such a device. In lamp fixture installations on a ceiling, for example, the force of gravity tends to urge such a device away from its locking position. Such a device, therefore, may become inadvertently dislodged from the lamp relatively easily. Further, as one section of such a device protrudes from the lamp holder, objects moving past a fluorescent lamp fitted with such a device might inadvertently snag the device. Such a lateral impact on a device of this type imparts a rotational force on the device and, hence, the bi-pins of the lamp. As a result, such forces actually tend to dislodge the lamp from the holder rather than preventing the lamp from rotating. Further, such a device necessarily requires two slots, one slot for each pin of the lamp and a specific configuration to match the particular lamp holder. As different sized lamps may have different spacing between pins and different lamp holder designs having different dimensions and shapes, a variety of sizes of such devices must be manufactured and correctly chosen from by the end user.

Clearly, then, there is a need for a locking device for fluorescent lamps that does not tend to become dislodged once installed. Such a needed device would not have protruding portions that could inadvertently be snagged by passers by. Further, such a needed device would fit all bi-pin type lamps, and would make suitable provision for lamp holders having different dimensions and sizes. Such a needed device would be extremely inexpensive to manufacture, and would not interfere in the normal operation of the lamp. The present invention fulfills these needs and provides further related advantages.

SUMMARY OF THE INVENTION

The present invention is a lamp lock for assembly of a fluorescent lamp to a lamp holder on a fluorescent lighting fixture. A wafer-like body portion is made of electrically insulating material that can withstand the temperatures experienced by bi-pins of the fluorescent lamp. In use, the body portion is inserted between an axial end of the lamp and an adjacent face of the lamp fixture. The body portion has a leading edge and is provided with a slot means extending through the leading edge for reception of the bi-pins.

The lamp lock further has a first lateral edge for sliding proximal engagement with a surface of the lamp fixture for preventing the locking means and the lamp from rotating, thereby securing the lamp to the lamp fixture. Preferably, the slot means extends between, and in parallel alignment with, the first lateral edge and a second lateral edge of the body portion, such that the distance between the first lateral edge and the slot means is greater than the distance between the second lateral edge and the slot means. In this way, the lamp lock may be used with at least two lighting fixtures of different sizes, each of which having different spacing between the lamp fixture surface and the bi-pins. Moreover, the first lateral edge of the locking means does not have to sit flush with the fixture surface in order to prevent the locking means and the lamp from rotating. Consequently, such a lamp lock may work for many more than two lighting fixtures of different sizes.

The present invention does not tend to become dislodged once installed, since the present device may always be oriented such that gravity does not urge the device away from its locking position. The present devices does not include protruding portions that can be inadvertently snagged by passers by.

Further, the present device fits all bi-pin type lamps, and makes suitable provision for lamp holders having different dimensions. The present invention is extremely inexpensive to manufacture, and does not interfere in the normal operation of the lamp. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 3:
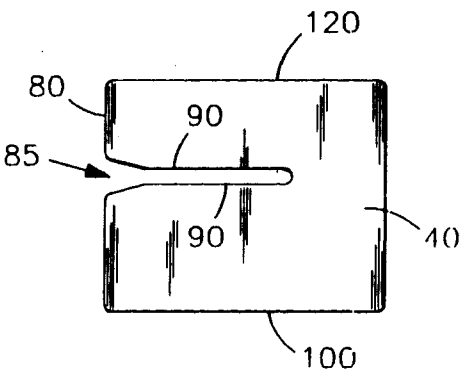
FIG. 3 is a left side elevational view of the invention, illustrating the slot means of FIG. 2 without the aperture means of FIG. 2 in the body portion of the invention.
Figure 2:
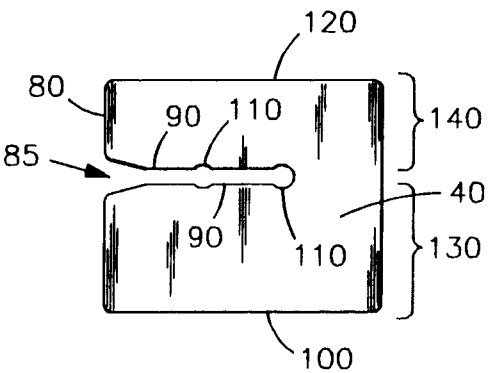
FIG. 2 is a left side elevational view of the invention, illustrating a slot means with aperture means in a body portion of the invention.
Figure 1:
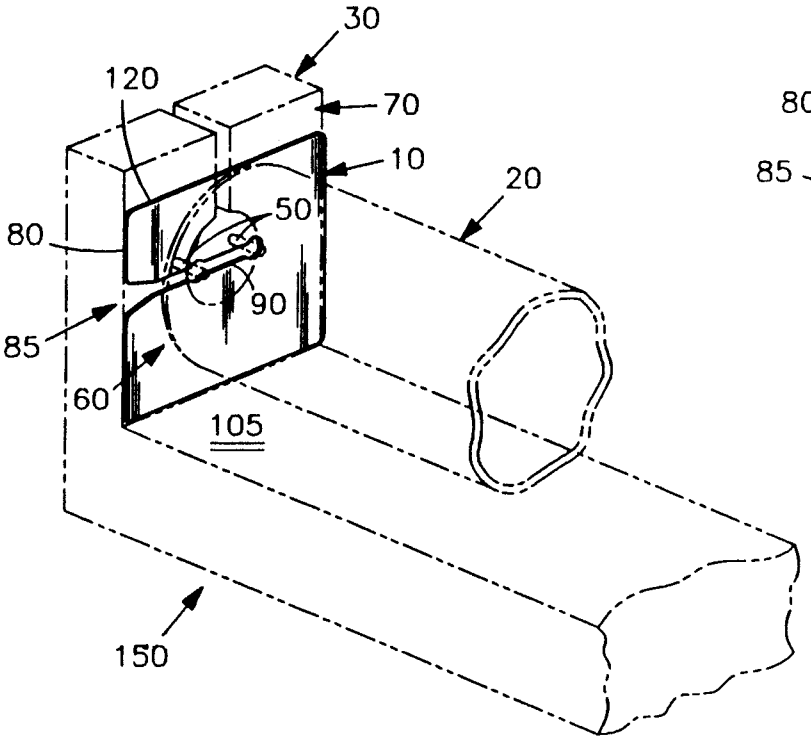
FIG. 1 is a perspective illustration of the invention, illustrating a lamp locking means inserted between a lamp holder means and the end of a partially illustrated fluorescent lamp.

FIGS. 1-3 illustrate a lamp locking means or device 10 for assembly of a fluorescent lamp 20 with a lamp holder means 30 such as a lamp socket. A flat wafer-like body 40 is made of electrically insulating material, such as high-temperature plastic sheet material, that can withstand the temperatures experienced by bi-pins 50 of the fluorescent lamp 20. The body 40 is inserted between an axial end 60 of the lamp 20 and an adjacent face 70 of the lamp holder means 30. The body 40 has a leading edge 80 and is provided with a linear slot 85 extending through the leading edge 80 for reception of the bi-pins 50. Preferably, the slot 85 is of a width slightly less than the diameter of the bi-pins 50. However, slot 85 of a width equal to or even slightly larger than the diameter of the bi-pins 50 will suffice. Walls 90 of the slot 85 engage the bi-pins 50 when the body 40 is inserted between the end 60 of the lamp 20 and the lamp holder means 30. Preferably, the body 40 is made of a significantly resilient material so that the bi-pins 50 force the slot walls 90 to deform in order to allow passage of the bi-pins 50 during insertion of the locking means 10. The walls 90 reform through the mechanism of elastic memory to engage the bi-pins 50 for holding the locking means 10 in place on the bi-pins 50. Additionally, aperture means 110 may be provided in the slot 85 for providing clearance for the bi-pins 50 when the locking means 10 is fully engaged with the bi-pins 50 and for further holding the locking means 10 in place on the bi-pins 50. An additional advantage of such aperture means 110 is that tactile feedback in the form of a detent is felt by the user when the locking means 10 has been fully engaged with the bi-pins 50.

The locking means 10 further has a first straight peripheral lateral edge 100 for sliding proximal engagement with a generally planar surface 105 a reference surface, proximate to the lamp holder means 30 for preventing the locking means 10 and the lamp 20 from rotating, thereby securing the lamp 20 to the lamp holder means 30. Clearly, the planar surface 105 can be any generally planar surface that is in close proximity to the lamp holder means 30, such as a surface of a reflector (not shown), a lamp mounting surface, or a lighting fixture structure 150. Preferably, the slot 85 of the locking means 10 extends between, and in parallel alignment with, the first lateral edge 100 and a second straight peripheral lateral edge 120 of the body 40, such that the distance 130 between the first lateral edge 100 and the slot 85 is greater than the distance 140 between the second lateral edge 120 and the slot 85. As such, the lamp locking means 10 provides effective anti-rotational control of the lamp 20 in the lamp holder means 30 which provides approximately a spacing 130 between the bi-pins 50 and the surface 105 of the lamp holder means 30. Moreover, by flipping the locking means 10 over such that the second lateral edge 120 takes the place of the first lateral edge 100, the lamp locking means 10 provides effective anti-rotational control in the holder means 30 that provides approximately a spacing 140 between the bi-pins 50 and the surface 105 of the second lamp holder means 30. In this way, the locking means 10 may be used with at least two sizes of lamp holder means 30, each of which have different spacing between the lamp holder surface 105 and the bi-pins 50. Moreover, the first lateral edge 100 of the locking means 10 does not have to sit perfectly flush against the lamp holder surface 105 in order to prevent the locking means 10 and the lamp 20 from rotating. Consequently, such a lamp locking means 10 is useful in lamp fixtures with any one of a range of bi-pins to reference surface spaces.

In operation, the fluorescent lamp 20 is installed into the lamp holder means 30, typically by aligning the bi-pins 50 with a slot in the lamp holder means 30, inserting the bi-pins fully into said slot, and then rotating the lamp 20 along its longitudinal axis, whereby the bi-pins 50 are rotated 90° out of alignment with said lamp holder slot. Then, based upon the spacing between the bi-pins 50 and the surface 105, either the first lateral edge 100 or the second lateral edge 120 of the locking means 10 is chosen to engage the lamp holder surface 105. The locking means 10 is then inserted between the end 60 of the lamp 20 and the adjacent face 70 of the means 30, the bi-pins 50 engaging the slot 85. As such, the lamp 20 is prevented from rotating within the lamp holding means 30, whereby the lamp 20 is prevented from becoming dislodged from the lamp holding means 30.

While the invention has been described with reference to a preferred embodiment, it is to be clearly understood by those skilled in the art that the invention is not limited thereto. For example, a handle means (not shown) could be easily added to the body portion 40 to facilitate removal of the locking means 30 from the lamp 20. Thus, the scope of the invention is to be interpreted only in conjunction with the appended claims.

What is claimed is:

1. A lamp locking device for locking a fluorescent lamp into a fluorescent lamp socket, the lamp being of the type having bi-pins extending from the lamp for engaging the lamp socket, the lamp requiring a 90 degree rotation for removal from the lamp socket, the lamp being further of the type mounted adjacent to a reference surface laying parallel to, and in proximity to the bi-pins, the locking device comprising:

a flat wafer-like body of electrically insulating material capable of sustaining fluorescent lamp operating temperature without changing shape, the body having a straight peripheral first lateral edge and a linear slot laying parallel to the first lateral edge and spaced apart therefrom, the slot being open and accessible from a leading edge of the body, and providing slot walls defining the extent of the slot and width thereof, a separation between the slot and the first lateral edge being approximately equal to the distance between the bi-pins of the lamp and the reference surface such that with the device inserted between the lamp and the lamp socket and with the slot engaging the bi-pin, the first lateral edge lays in close proximity to the reference surface so that the lamp cannot turn in the lamp socket without the lamp locking device turning with it, as urged by the bi-pins, contact between the first lateral edge and the reference surface preventing lamp rotation and removal from the lamp socket.

2. The device of claim 1 wherein the linear slot width is smaller than the diameter of the bi-pins, further the body being of a resiliency such that upon installation of the device, the bi-pins force the slot walls to deform thereby allowing the slot width to open for passage of the bi-pins during insertion of the flat wafer-like body, and thereafter the slot walls exert an elastic holding force on the bi-pins thereby prevented the device from falling out of place from between the lamp and the lamp socket.

3. The device of claim 1 further including aperture means within the slot walls for providing clearance for the bi-pins and enabling tactile feedback to assure that the device is seated in the bi-pins.

4. The device of claim 1 wherein the device is of a hard flexible material such that the body deforms to enable the slot to open during insertion of the device onto the bi-pins, the slot resuming the normal slot width thereafter for attachment of the device to the bi-pins.

5. The device of claim 1 further including a second straight lateral edge in parallel alignment with the slot and the first lateral edge, the slot laying asymmetrically between the first and second edges such that the device may be used effectively over a range of said distances between the bi-pins and the reference surface.

* * * * *